United States Patent [19]

Lagemann et al.

[11] 4,111,756

[45] Sep. 5, 1978

[54] METHOD OF AND APPARATUS FOR HEATING UP A CHAMBER OF A COKING BATTERY

[75] Inventors: Günther Lagemann; Wilhelm Heisterkamp, both of Essen, Germany

[73] Assignee: Krupp-Koppers GmbH, Essen, Germany

[21] Appl. No.: 741,186

[22] Filed: Nov. 12, 1976

[30] Foreign Application Priority Data

Nov. 14, 1976 [DE] Fed. Rep. of Germany ..... 2551197

[51] Int. Cl.[2] ..... C10B 23/00; C10B 27/00

[52] U.S. Cl. ..... 201/41; 201/26; 201/43; 202/144; 432/177

[58] Field of Search ..... 201/10, 13, 14, 36, 201/37, 41, 26; 202/144, 270; 432/29, 30, 177, 178

[56] References Cited

U.S. PATENT DOCUMENTS

| | | | |
|---|---|---|---|
| 1,485,914 | 3/1924 | Green | 201/36 X |
| 1,898,267 | 2/1933 | Schaefer | 201/37 |
| 2,006,115 | 6/1935 | Schaefer | 201/26 X |
| 2,065,288 | 12/1936 | Otto | 201/26 |
| 2,194,359 | 3/1940 | Koppers | 201/36 X |

*Primary Examiner*—Morris O. Wolk
*Assistant Examiner*—Michael S. Marcus
*Attorney, Agent, or Firm*—Michael J. Striker

[57] ABSTRACT

After replacement of the walls of one chamber of a coking battery this one chamber is heated up by withdrawing relatively hot air from another still-hot chamber of the coking battery and injecting it into the cold chamber. This is done by means of a conduit extending between the two chambers and provided with an internal nozzle that conducts the hot gas from the hot chamber to the cool chamber by jet-pump action. This hot gas is mixed with relatively cool air so as slowly to heat the cool chamber up.

7 Claims, 2 Drawing Figures

METHOD OF AND APPARATUS FOR HEATING UP A CHAMBER OF A COKING BATTERY

BACKGROUND OF THE INVENTION

The present invention relates to a coking battery. More particularly this invention concerns a method of operating a multichamber coking battery and an apparatus for heating up one chamber of such a battery after its walls had been renewed or replaced.

It is necessary periodically to renew the refractory walls of a coking battery. Rarely must all of the walls be renewed or replaced at the same time, so that frequently only one or more of these walls must be replaced, in particular those walls which are so worn that the flues are opened up into the chambers.

After replacement of walls of coking chambers it is necessary to heat these walls up to the necessary temperature, above 1000° C, so that a coking operation can be carried out. Such heating-up must be carried out extremely slowly, in order to prevent the new walls from cracking and in order to cure the refractory material constituting them.

Thus, it is standard procedure to fit a burner to the aperture in one of the doors of the coking chamber and to line the new walls of this chamber with a protective asbestos mat or the like. The burner is then fired up and operated for a sufficient time to produce the desired temperture in the walls.

Such a system has several disadvantages. First of all the provision of the protective lining for the new walls is relatively difficult and removal of this lining once the chamber is heated to the desired very high temperature is also very difficult. Furthermore, the use of a burner not only entails considerable fuel expense, but also presents the real danger of explosion should the burner become temporarily extinguished and the gases thereafter reignite on the hot walls.

SUMMARY OF THE INVENTION

It is therefore an object of the present invention to provide an improved method of operating a coking battery.

Another object is the provision of an improved apparatus for heating up a relatively cold chamber of such a battery another of whose chambers is relatively hot.

Yet another object is to provide such a system which does not require painstaking lining of the chamber being heated and which does not make use of a potentially dangerous burner.

These objects are attained according to the present invention by withdrawing hot gas from a heated chamber of the battery and directing the hot gas into another chamber to heat the walls of this other chamber. This method eliminates the necessity of using a burner, as the heat already in the system can be employed to heat up the cold chamber. Since the heat can be withdrawn from one of the coke chambers which is at a relatively moderate temperature the necessity of lining the chamber being heated up is further avoided.

In accordance with yet another feature of this invention the hot gas withdrawn from the hot chamber is reduced in temperature somewhat before injection into the cold chamber. This may be done by mixing it with a cool gas at the outlet or downstream end of the conduit connecting the two chambers.

According to a further feature of this invention the hot gases are withdrawn by jet-pump action. This is effected by providing in the conduit extending between the two chambers a pipe having a nozzle end which is directed toward the cool chamber and which is connected to a source of gas under pressure. Thus the stream issuing from this nozzle end serves to entrain a gas in the upstream end and out the downstream end of the conduit.

This pipe has a section between the source of gas under pressure and the nozzle end which extends through the hot chamber. Thus the gas under for the jet-pump action is preheated before it is used.

In accordance with yet another feature of this invention, means is provided for mixing a relatively cool gas, here air, with the hot gas at the downstream end of the conduit connecting the two chambers. This includes a tube of larger diameter than the conduit at the downstream end which concentrically receives the conduit with annular spacing. The tube has an inner end in the cool chamber extending beyond the downstream end of the conduit and an outer end opening outside the hot chamber. The opening of this tube at its outer end can be varied in order to control the amount of cool air mixed with the hot air. Thus, in accordance with yet another feature of this invention it is possible to steadily and continuously increase the temperature of the air injected into the cold chamber until it has a temperature of approximately 850° C.

The novel features which are considered as characteristic for the invention are set forth in particular in the appended claims. The invention itself, however, both as to its construction and its method of operation, together with the additional objects and advantages thereof will be best understood from the following description of a specific embodiment when read in connection with the accompanying drawings.

SPECIFIC DESCRIPTION OF A PREFERRED EMBODIMENT

Figure 1:
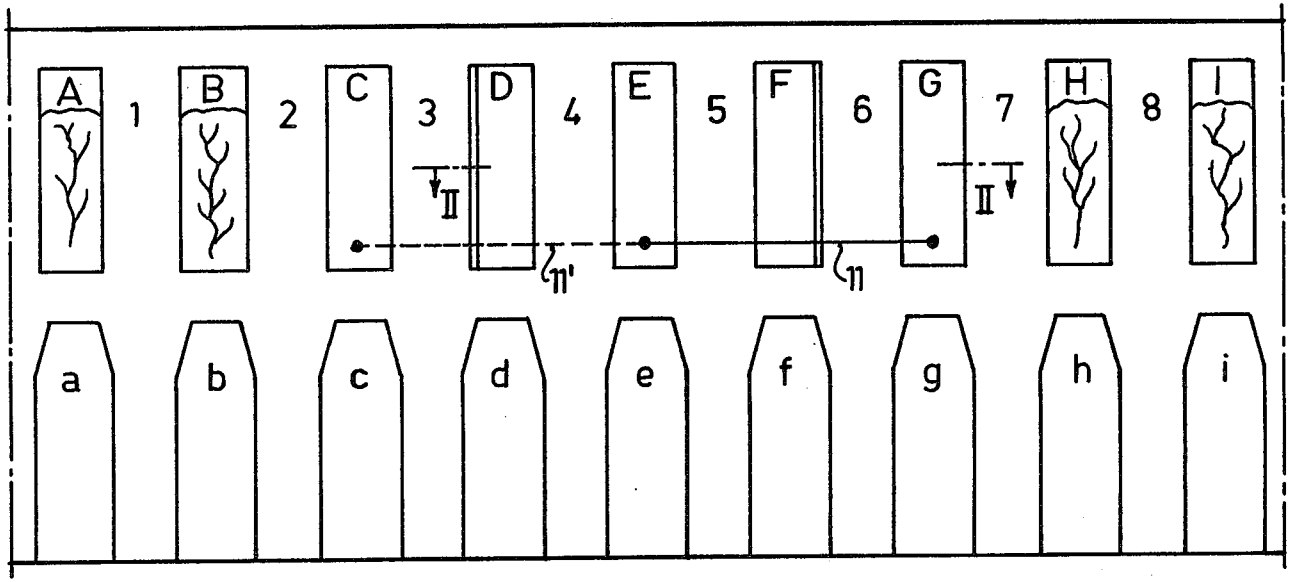
FIG. 1 is a largely diagrammatic vertical section through a coking battery in accordance with this invention.

As shown in FIG. 1 a coking battery has a plurality of walls 1 - 8 separating coking A – I each of which overlies a respective regenerator *a* – *i*. In the arrangement shown the innermost walls 4 and 5 are being renewed. The outermost coking chambers A, B, H and I are continued to be used for coking. The this end their walls 1, 2, 7 and 8 are heated by means of internal flues known in the art to approximately 1200° C. The walls 3 and 6 are, however, only maintained at a temperature of around 920° C which is too low for coking in the adjacent chambers C and G.

Figure 2:
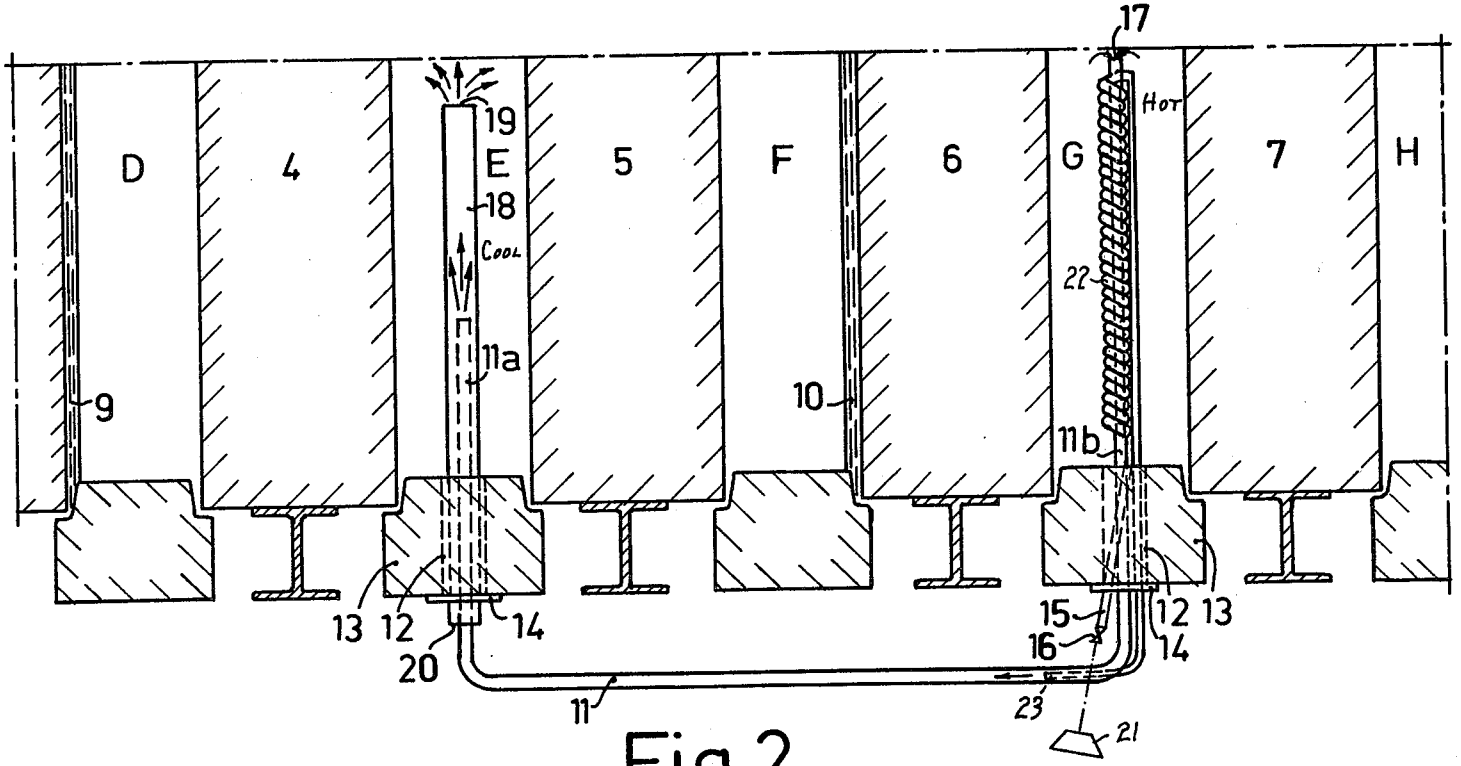
FIG. 2 is a horizontal section taken along line II—II of FIG. 1.

FIG. 2 shows how the walls 3 and 6 are provided on their faces turned toward each other with insulation 9 and 10, respectively. Each of the chambers A – I has a vertical door 13 each formed with a filling opening 12.

In accordance with this invention a medium-diameter conduit 11 has a downstream end section 11*a* extending through the hole 12 of the chamber E which is cold and an upstream section 11*b* extending through the hole 12 of the relatively warm chamber G. This section 11*b* has a downstream end located well within this chamber G whose filling opening is left open or ajar to allow air to be drawn into this chamber G. Flanges 14 secure the conduit 11 to the doors 13 over the holes 12.

In addition a source 21 of air under pressure is connected via a valve 16 to a pipe 15 and has a helical section 22 lying inside the chamber G and concentrically surrounding the upstream section 11*b*. This tube 15 then extends out again through the hole 12 of the chamber G and is inserted through the elbow into the medium-diameter tube 15 where it has a nozzle end 23 which is directed in the tube 11 toward the downstream end 11*a* thereof.

This downstream end 11*a* is concentrically received within a relatively large-diameter tube 18 that extends well into the chamber E beyond the downstream end of the section 11*a* and which opens externally at 20 outside the chamber E.

Thus in use the chamber G is heated to approximately 800° -900° C. The source 21, here a compressor, is operated to force air through the tube 15. This air is preheated as it passes through the coil 22 and then when injected at 23 into the conduit 11 causes air to flow in this conduit 11 from the upstream end 17 toward the downstream section 11*a*. This jet-pump action is reinforced by the jet-pump action of the downstream section 11*a* in the tube 18 so that the air exiting at 19 from the tube 18 in the chamber E is a mixture of relatively cool ambient air and the relatively hot air drawn out of the chamber G. The flange 14 on the door 13 of the chamber E is adjustable so as to vary the cross-sectional area between the section 11*a* and the tube 18. Thus the amount of cold air admixed with the hot air issuing from the tube 11 can be varied. In use this amount is slowly decreased from a maximum level until the chamber E is at the desired temperature of approximately 850° C. The air in the tube 15 is warmed to apprpximately 450° C by the coil 22.

It is also possible to provide as shown in FIG. 1 another conduit 11' between the chamber C and the chamber E.

It will be understood that each of the elements described above, or two or more together, may also find a useful application in other types of coking systems differing from the types described above.

While the invention has been illustrated and described as embodied in a method of operating a coking battery and apparatus therefor, it is not intended to be limited to the details shown, since various modifications and structural changes may be made without departing in any way from the spirit and scope of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of heating cold walls of a renewed coking chamber in a working multi-chamber coking battery in which at least one operative coking chamber is maintained, said method comprising the steps of maintaining at least one coking chamber at a reduced non-coking temperature, withdrawing hot gas from said reduced-temperature chamber and injecting said withdrawn hot gas into said renewed chamber to heat the walls of the same.

2. The method defined in claim 1, further comprising the step of admitting cool gas to said reduced-temperature chamber to replace mix with said hot gas therein.

3. The method defined in claim 1 wherein said hot gas is withdrawn by jet-pump action.

4. The method defined in claim 1, further comprising the step of reducing the temperature of said hot gas before injecting same into said renewed chamber.

5. The method defined in claim 1 further comprising mixing said hot gas with relatively cool gas before injection of said hot gas into said renewed chamber.

6. A method as claimed in claim 5, wherein said cool gas is preheated in said idling chamber.

7. A method as claimed in claim 5, wherein said cool gas is introduced into said hot gas under increased pressure.

* * * * *